US010593264B2

(12) United States Patent
Wang et al.

(10) Patent No.: US 10,593,264 B2
(45) Date of Patent: Mar. 17, 2020

(54) POWER SUPPLY DEVICE FOR DISPLAY PANEL, MANUFACTURING METHOD, POWER SUPPLYING METHOD AND DISPLAY DEVICE

(71) Applicants: BOE TECHNOLOGY GROUP CO., LTD., Beijing (CN); Ordos Yuansheng Optoelectronics Co., Ltd., Inner Mongolia (CN)

(72) Inventors: Xiaowei Wang, Beijing (CN); Guoqing Zhang, Beijing (CN); Hongxia Yang, Beijing (CN); Longfei Yang, Beijing (CN); Feiwen Tian, Beijing (CN); Lei Wang, Beijing (CN); Xuepeng Ji, Beijing (CN); Yu Fu, Beijing (CN); Haotian Chen, Beijing (CN); Meili Guo, Beijing (CN)

(73) Assignees: BOE TECHNOLOGY GROUP CO., LTD., Beijing (CN); ORDOS YUANSHENG OPTOELECTRONICS CO., LTD., Inner Mongolia (CN)

( * ) Notice: Subject to any disclaimer, the term of this patent is extended or adjusted under 35 U.S.C. 154(b) by 7 days.

(21) Appl. No.: 15/993,832

(22) Filed: May 31, 2018

(65) Prior Publication Data

US 2019/0164482 A1 May 30, 2019

(30) Foreign Application Priority Data

Nov. 24, 2017 (CN) ..... 2017 1 1192115

(51) Int. Cl.
*G09G 3/3233* (2016.01)
*G09G 3/20* (2006.01)

(52) U.S. Cl.
CPC ..... *G09G 3/3233* (2013.01); *G09G 3/20* (2013.01); *G09G 2300/0426* (2013.01);
(Continued)

(58) Field of Classification Search
CPC ..... G09G 3/3233
See application file for complete search history.

(56) References Cited

U.S. PATENT DOCUMENTS

2003/0062844 A1* 4/2003 Miyazawa ..... G09G 3/3241 315/169.3
2006/0022969 A1* 2/2006 Lee ..... G02F 1/136286 345/211

(Continued)

*Primary Examiner* — Ariel A Balaoing
(74) *Attorney, Agent, or Firm* — Calfee, Halter & Griswold LLP

(57) ABSTRACT

The present disclosure relates to a power supply device for a display panel, a manufacturing method, a power supplying method, and a display device. The power supply device may include: a first line surrounding the display panel and electrically connected to sub-pixels of the display panel; at least one first power supply terminal disposed at a first side of the display panel and connected to a first line segment of the first line located at the first side of the display panel; at least one second power supply terminal connected to a second line segment of the first line located at a second side of the display panel to compensate for a voltage drop of the first power supply terminal on the first line. The first side and the second side of the display panel are opposite sides of the display panel.

5 Claims, 3 Drawing Sheets

(52) U.S. Cl.
CPC ..... *G09G 2310/0264* (2013.01); *G09G 2320/0223* (2013.01); *G09G 2330/04* (2013.01)

(56) References Cited

U.S. PATENT DOCUMENTS

2007/0096135 A1* 5/2007 Matsumoto ..... H01L 27/3276 257/99
2008/0174731 A1* 7/2008 Kang ..... G02F 1/133615 349/150
2017/0236471 A1* 8/2017 Ota ..... G09G 3/3258 345/76

* cited by examiner

POWER SUPPLY DEVICE FOR DISPLAY PANEL, MANUFACTURING METHOD, POWER SUPPLYING METHOD AND DISPLAY DEVICE

CROSS-REFERENCE TO RELATED APPLICATIONS

This application claims priority to Chinese Patent Application 201711192115.5 filed Nov. 24, 2017, the entire contents of which are incorporated herein by reference.

TECHNICAL FIELD

The present disclosure relates to the display technical field, and in particular, to a power supply for a display panel, a method for manufacturing a display panel, a method for supplying power to a display panel and a display device.

BACKGROUND

Display panels are applied in various technical fields for forming specific images. In related arts, a plurality of sub-pixels arranged in an array are disposed on a display panel, and a plurality of sub-pixel combinations can form different images on the display panel.

In related arts, a plurality of sub-pixels need to be connected to power supply terminals through wirings or lines. During providing of a driving voltage to the plurality of sub-pixels by the power supply terminals, sub-pixels on a side of the display panel far from the power supply terminals have a voltage drop due to wiring or line resistance, resulting in that the brightness of sub-pixels near the power supply terminals is greater than the brightness of sub-pixels far from the power supply terminals. As a result, the brightness of the display panel is uneven.

In related arts, the voltage drops caused by the wiring is generally reduced by increasing the line width to reduce the impedance of the line, thereby reducing the brightness difference at both sides of the display panel. However, the effect of this method is not obvious.

It should be noted that the information disclosed in the background section is only for enhancement of understanding of the background of the disclosure and therefore may include information that does not constitute prior art that is already known to those of ordinary skill in the art.

SUMMARY

Other features and advantages of the disclosure will be apparent from the following detailed description, or may be learned in part through the practice of the disclosure.

According to an aspect of embodiments of the present disclosure, there is provided a power supply device for a display panel, including a first line, at least one first power supply terminal and at least one second power supply terminal. The first line surrounds the display panel and is electrically connected to sub-pixels of the display panel. The at least one first power supply terminal is disposed at a first side of the display panel and connected to a first line segment of the first line located at the first side of the display panel. The at least one second power supply terminal is connected to a second line segment of the first line located at a second side of the display panel to compensate for a voltage drop of the first power supply terminal on the first line. The first side and the second side of the display panel are opposite sides of the display panel. The second power supply terminal is used to compensate for a voltage drop of the first power supply terminal on the first line.

According to an exemplary embodiment of the present disclosure, there are two second power supply terminals, and the two second power supply terminals are connected to two ends of the second line segment, respectively.

According to an exemplary embodiment of the present disclosure, the two second power terminals are located at the first side of the display panel, and the two second power terminals are connected to the two ends of the second line segment via a second line, respectively.

According to an exemplary embodiment of the present disclosure, the first power supply terminal and the second power supply terminal both provide a high level or both provide a low level.

According to an exemplary embodiment of the present disclosure, wherein the absolute value of the voltage at the second power terminal is greater than the absolute value of the voltage at the first power terminal.

According to another aspect of embodiments of the present disclosure, there is provided a method for manufacturing a display panel, including:

electrically connecting sub-pixels of the display panel with a first line surrounding the display panel;

connecting a first line segment of the first line located at a first side of the display panel with at least one first power supply terminal;

connecting a second line segment of the first line located at a second side of the display panel with at least one second power supply terminal;

wherein the first side and the second side of the display panel are opposite sides of the display pane, and the second power supply terminal is used for compensating a voltage drop of the first power supply terminal on the first line.

According to an exemplary embodiment of the present disclosure, there are two second power supply terminals, and the two second power supply terminals are connected to two ends of the second line segment, respectively.

According to an exemplary embodiment of the present disclosure, the two second power terminals are located at the first side of the display panel, and the two second power terminals are connected to the two ends of the second line segment via a second line, respectively.

According to another aspect of embodiments of the present disclosure, there is provided a method for supplying power to a display panel, wherein the method is applied in the power supply device as described above, and the method comprises:

providing a driving voltage to the sub-pixels of the display panel through the first line segment by the first power supply terminal; and providing a driving compensation voltage to the sub-pixels of the display panel through the second line segment by the second power supply terminal.

According to another aspect of embodiments of the present disclosure, there is provide a display device comprising the power supply device for a display panel as described above.

It should be understood that the foregoing general description and the following detailed description are exemplary and explanatory only and should not be deemed as limiting the present disclosure.

BRIEF DESCRIPTION OF THE DRAWINGS

The accompanying drawings, which constitute a part of the description, are incorporated in this description, illustrate embodiments consistent with the present disclosure, and together with the description serve to explain the principles of the disclosure. Obviously, the drawings in the following description are only some exemplary embodiments of the present disclosure, and for those of ordinary skill in the art, other drawings can be made in accordance with these drawings.

DETAILED DESCRIPTION

Figure 1:
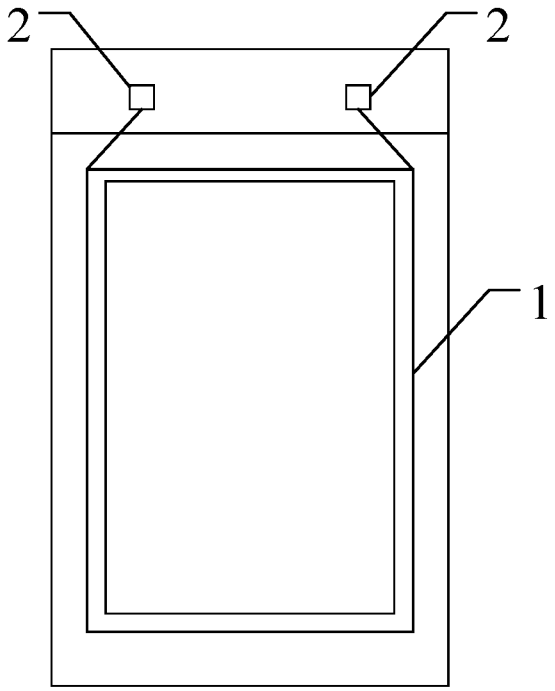
FIG. 1 is a schematic diagram showing a structure of a power supply device for a display panel in related arts.

Exemplary embodiments will now be described more fully with reference to the accompanying drawings. However, exemplary embodiments can be implemented in various forms and should not be construed as limited to the examples set forth herein; rather, these embodiments are provided to make this disclosure more complete, and to fully convey the concept of the exemplary embodiments to those skilled in this art. The same reference numerals in the drawings denote the same or similar structures, and thus their detailed description will be omitted.

Although relative terms are used in this specification, for example, "on/above" and "below/under", to describe the relative relationship of one component to another component, these terms are used in this specification for convenience only. For example, these terms are used according to the direction as illustrated in the drawings. It will be understood that if a device in the drawings is turned upside down, the component described as "on" another component will become "below" the another component. Other relative terms such as "high", "low", "top", "bottom", "left" and "right" also have similar meanings. When a structure is "on" another structure, it may mean that the structure is integrally formed on the another structure, or that the structure is "directly" disposed on the another structure, or that the structure is "indirectly" disposed on the another structure.

The terms "a", "an", "the" are used to indicate the presence of one or more elements/components and so on. The terms "comprising" and "having" are used to indicate an open-ended meaning and mean that there may be additional elements/components and so on in addition to the listed elements/components.

FIG. 1 is a schematic diagram showing a structure of a power supply device for a display panel in related arts. The display panel is provided with a plurality of sub-pixels arranged in an array. The plurality of sub-pixels are connected to power supply terminals 2 through a line (or a wiring) 1 surrounding the display panel. The power supply terminals 2 are located at one side of the display panel. When the power supply terminals 2 provide a driving voltage to the subpixels, a voltage drop exists on the side far from the power supply terminals due to the wiring (or) resistance, thereby resulting in that the brightness of sub-pixels of the display panel located on the power supply terminal side is greater than the brightness of the sub-pixels far from the power supply terminal side.

Firstly, an exemplary embodiment of the present disclosure provides a power supply device for a display panel.

Figure 2:
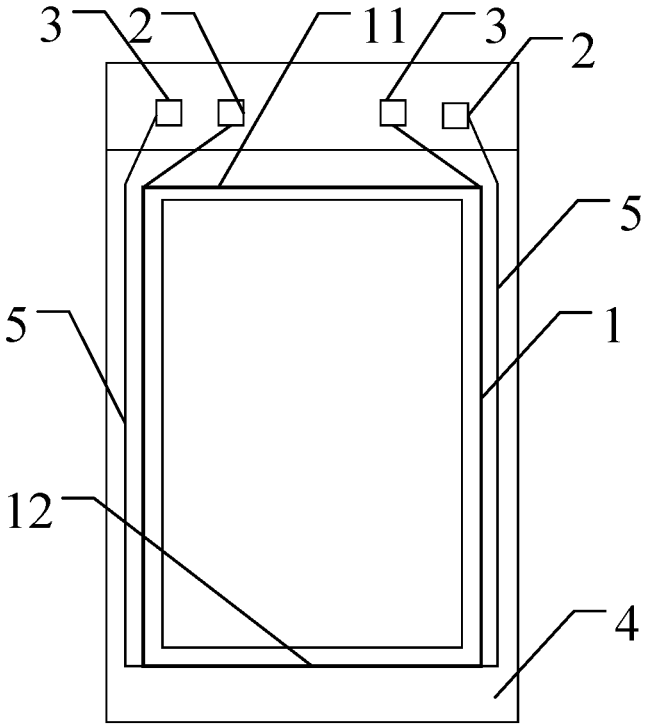
FIG. 2 is a schematic diagram showing an arrangement of power supply device for a display panel according to an exemplary embodiment of the present disclosure.

FIG. 2 is a schematic diagram showing an arrangement of power supply device for a display panel according to an exemplary embodiment of the present disclosure. The power supply for a display panel includes a first line 1, at least one first power supply terminal 2 and at least one second power supply terminal 3. The first line 1 surrounds the display panel 4 and is electrically connected to sub-pixels of the display panel. The at least one first power supply terminal 2 is disposed at a first side of the display panel and connected to a first line segment 11 of the first line 1 located at the first side of the display panel 4. The at least one second power supply terminal 3 is connected to a second line segment 12 of the first line 1 located at a second side of the display panel 4. The first side and the second side of the display panel 4 are opposite sides of the display panel. The second power supply terminal is used to compensate for a voltage drop of the first power supply terminal on the first line. It should be noted that the display panel in this exemplary embodiment may be various display panels that need to drive sub-pixels. For example, the display panel may be a Liquid Crystal Display (LCD) display panel or an Organic Light Emitting Diode (OLED) display panel.

In the power supply device for a display panel provided in this exemplary embodiment, by providing at least one second power terminal for compensating the voltage drop of the first line in the display panel, the voltage distribution of the first line may be more uniform. Therefore, on the one hand, the device can effectively reduce the attenuation of the brightness from the first side to the second side of the display panel and improve the brightness uniformity of the display panel. On the other hand, the device is simple in structure and low in cost.

In the exemplary embodiment, the first power terminal has a certain driving voltage for driving the sub-pixels on the display panel 4 to emit light, and the first power terminal 2 is connected to the first line segment 11 of the first line located at the first side of the display panel 4. There is a significant voltage drop from the first side of the display panel 4 to the second side of the display panel due to the presence of the resistance of the first line itself. As a result, the brightness of the sub-pixels on the display panel 4 gradually attenuates from the first side to the second side. In the present exemplary embodiment, at least one second power supply terminal 3 is further provided. The second power supply terminal 3 can be connected to the second line segment 12 of the first line 1 located at the second side of the display panel 4. The second power supply terminal 3 also has a certain driving voltage for compensating for the voltage of the first power terminal 2 on the first line 1.

In the present exemplary embodiment, to drive the sub-pixels to emit light requires applying a voltage between the positive and negative polarities of the sub-pixels to generate an electric field. The first power supply terminal and the second power supply terminal may both provide a high level, and a low level is applied to the other electrodes of the sub-pixels. Both the first power supply terminal and the second power supply terminal can also provide a low level, and a high level is applied to the other electrodes of the sub-pixels. For example, when a sub-pixel of the display panel is driven, a positive voltage may be applied to the positive electrode of the sub-pixel, a negative voltage may be applied to the negative electrode of the sub-pixel, and the sub-pixel may be driven to emit light by simultaneously operating the positive and negative voltages. In the present exemplary embodiment, the structure and the principle of the power supply device in the driving circuit for the positive and negative electrodes of the sub-pixels are the same. The display panel power supply device can be used in a cathode driving circuit for sub-pixels. At this time, the first power supply terminal 2 outputs a negative voltage, and the second power supply terminal 3 outputs also a negative voltage. The display panel power supply device can also be used in an anode driving circuit for the sub-pixels, and under such condition, the first power supply terminal 2 outputs a positive voltage, and the second power supply terminal 3 outputs also a positive voltage.

Figure 3:
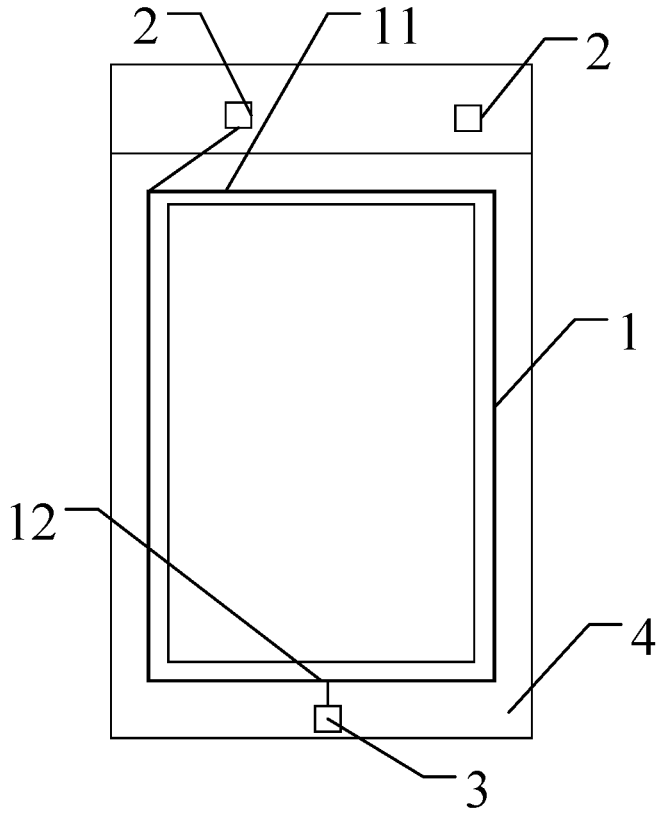
FIG. 3 is a schematic diagram showing an arrangement of power supply device for a display panel according to an exemplary embodiment of the present disclosure.

As shown in FIG. 2, in the present exemplary embodiment, there is a voltage drop at both ends of the first line 1 connected to the first line segment 11 and the second lines segment 12, respectively. Therefore, there may be two second power supply terminals 3, and the two second power supply terminals 3 may be connected to two ends of the second line section, respectively, and provide compensation voltages at both ends of the second line section. It should be understood that the number of the second power supply terminals 3 may vary. FIG. 3 is a schematic diagram showing an arrangement of power supply device for a display panel according to an exemplary embodiment of the present disclosure. As shown in FIG. 3, there is one second power supply terminal 3, and the second power supply terminal 3 is connected with the middle portion of the second line section 12. The second power supply terminal 3 can provide compensation voltages for both sides of the second line segment 12. All such modifications fall within the protection scope of the present disclosure.

In order to utilize the space rationally, in the present embodiment, as shown in FIG. 2, two second power supply terminals 3 and the first power supply terminal 2 are located at the same side of the display panel, that is, at the first side of the display panels 4. The two second power supply terminals 3 are connected to the two ends of the second line segment through the second line 5. It should be understood that there are other options for the positions of the second power supply terminals 3. For example, as shown in FIG. 3, the second power supply terminal 3 can be located at the second side of the display panel. All such modifications fall with the scope of the present disclosure.

It should be noted that, in the present exemplary embodiments, the second power supply terminal(s) 3 is(are) used for providing the compensation voltage to the second line segment 12 so that the voltage at the second line segment is the same as the voltage at the first line segment 11. Therefore, the voltage output from the second power supply terminals 3 to the second line segment is not less than the voltage at the first power supply terminal 2. In addition, the resistance of the second lien 5 5 itself generates a voltage drop to the second power supply terminal 3. Therefore, the absolute value of the voltage at the second power terminal(s) is greater than the absolute value of the voltage at the first power terminal. When the first power supply terminal 2 and the second power supply terminal(s) 3 are a positive voltage, the first power supply terminal voltage is smaller than the second power supply terminal voltage. When the first power supply terminal 2 and the second power supply terminal(s) 3 are negative voltages together, the first power supply terminal voltage is greater than the second power supply terminal voltage.

Figure 4:
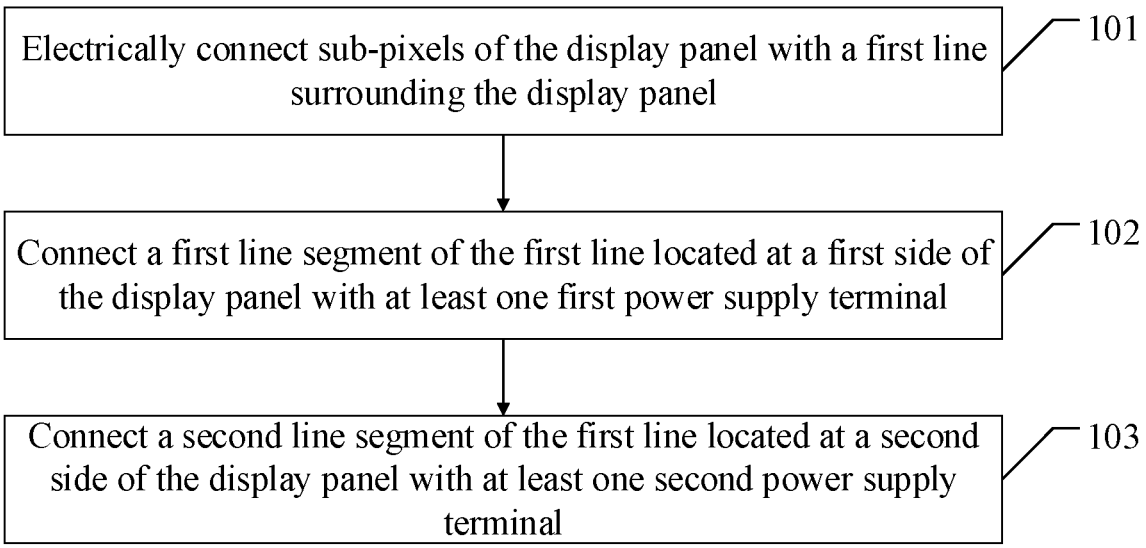
FIG. 4 is a flow chart showing a method for manufacturing a display panel according to an exemplary embodiment of the present disclosure.

An exemplary embodiment of the present disclosure also provides a method for manufacturing a display panel. FIG. 4 is a flow chart showing a method for manufacturing a display panel. The method for manufacturing the display panel may include the following steps.

In step S101, sub-pixels of the display panel are electrically connected with a first line surrounding the display panel.

In step S102, a first line segment of the first line located at a first side of the display panel is connected with at least one first power supply terminal.

In step S103, a second line segment of the first line located at a second side of the display panel is connected with at least one second power supply terminal.

The first side and the second side of the display panel are opposite sides of the display pane, and the second power supply terminal is used for compensating a voltage drop of the first power supply terminal on the first line.

According to an exemplary embodiment, there are two second power supply terminals, and the two second power supply terminals are connected to two ends of the second line segment, respectively.

According to an exemplary embodiment, both the first power supply terminal and the second power supply terminal output a positive voltage or a negative voltage.

According to an exemplary embodiment, the absolute value of the voltage at the second power terminal is greater than the absolute value of the voltage at the first power terminal.

It should be noted that the method for manufacturing the display panel provided by the exemplary embodiment has the same structure and working principle as the above-mentioned power supply device. The structure and working principle have been described in detail and will not be repeated herein.

Figure 5:
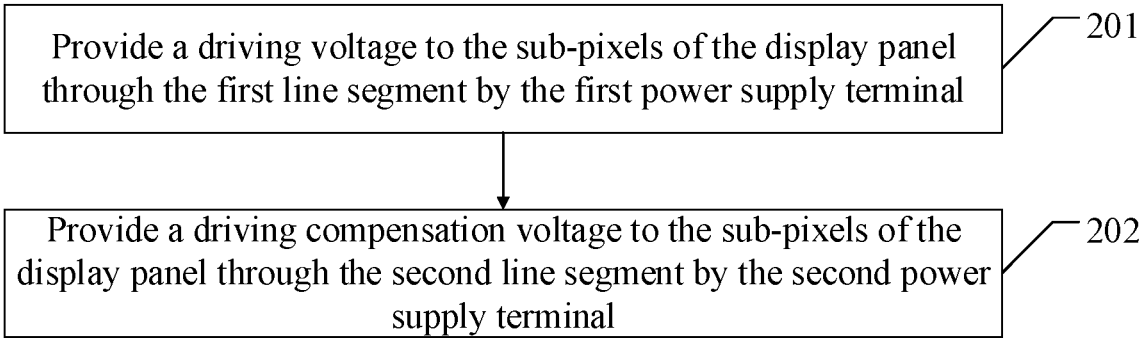
FIG. 5 is a flow chart showing a method for supplying power to a display panel according to an exemplary embodiment of the present disclosure.

An exemplary embodiment further provides a method for supplying power to a display panel. FIG. 5 is a flow chart showing a method for supplying power to a display panel according to an exemplary embodiment of the present disclosure. The method for supplying power to a display panel may be applied in the power supply device as described above, and the method may include the following steps:

In step S201, a driving voltage is provided to the sub-pixels of the display panel through the first line segment by the first power supply terminal.

In step S202, a driving compensation voltage is provided to the sub-pixels of the display panel through the second line segment by the second power supply terminal.

In an exemplary embodiment, both the first and second power supply terminals output a positive voltage or a negative voltage.

It should be noted that the method for supplying power to the display panel provided by the exemplary embodiment has the same structure and working principle as the above-mentioned power supply device. The structure and working principle have been described in detail and will not be repeated herein.

An exemplary embodiment of the present disclosure further provides a display device including the above-described power supply device for a display panel. The power supply device for the display panel may be applied in a cathode driving circuit for sub-pixels of the display device, or may be applied in an anode driving circuit for sub-pixels of the display device. Alternatively, the power supply device for the display panel may be applied in both anode and cathode driving circuits for sub-pixels of the display device.

Those skilled in the art will readily recognize other embodiments of the present disclosure upon consideration of the description and practice. This application is intended to cover any variations, usages, or adaptations of the present disclosure that follow the general principles of the disclosure and include the common general knowledge or conventional technical means in this technical field. The description and embodiments are to be considered exemplary only, and the true scope of the disclosure is defined by the appended claims.

The features, structures, or characteristics described above may be combined in any suitable manner in one or more embodiments and, if possible, the features discussed in the various embodiments are interchangeable. In the above description, numerous specific details are provided to provide a thorough understanding of the embodiments of the present disclosure. However, those skilled in the art will recognize that the technical solutions of the present disclosure may be practiced without one or more of the specific details, or that other methods, components, materials, and so on may be employed. In other instances, well-known structures, materials, or operations are not shown or described in detail to avoid obscuring aspects of the present disclosure.

What is claimed is:

1. A power supply device for a display panel, comprising:

a first line, electrically connected to sub-pixels of the display panel and being shaped as a closed shape around the display panel;

at least one first power supply terminal, disposed at a first side of the display panel and connected to a first line segment of the first line located at the first side of the display panel;

at least one second power supply terminal, connected to a second line segment of the first line located at a second side of the display panel to compensate for a voltage drop of the first power supply terminal on the first line;

wherein the first side and the second side of the display panel are opposite sides of the display panel;

wherein two second power supply terminals are connected to two ends of the second line segment, respectively;

wherein the two second power terminals are located at the first side of the display panel, and the two second power terminals are connected to the two ends of the second line segment via a second line, respectively; and wherein an absolute value of a voltage at the second power terminal is greater than an absolute value of a voltage at the first power terminal.

2. The power supply device according to claim 1, wherein the first power supply terminal and the second power supply terminal both provide a high level or both provide a low level.

3. A method for manufacturing a display panel, comprising:

electrically connecting sub-pixels of the display panel with a first line being shaped as a closed shape around the display panel;

connecting a first line segment of the first line located at a first side of the display panel with at least one first power supply terminal;

connecting a second line segment of the first line located at a second side of the display panel with at least one second power supply terminal;

wherein the first side and the second side of the display panel are opposite sides of the display pane, and the second power supply terminal is used for compensating a voltage drop of the first power supply terminal on the first line;

wherein two second power supply terminals are connected to two ends of the second line segment, respectively;

wherein the two second power terminals are located at the first side of the display panel, and the two second power terminals are connected to the two ends of the second line segment via a second line, respectively; and wherein an absolute value of a voltage at the second power terminal is greater than an absolute value of a voltage at the first power terminal.

4. A display device comprising a power supply device for a display panel;

wherein the power supply device comprises:

a first line, electrically connected to sub-pixels of the display panel and being shaped as a closed shape around the display panel;

at least one first power supply terminal, disposed at a first side of the display panel and connected to a first line segment of the first line located at the first side of the display panel;

at least one second power supply terminal connected to a second line segment of the first line located at a second side of the display panel to compensate for a voltage drop of the first power supply terminal on the first line;

wherein the first side and the second side of the display panel are opposite sides of the display panel;

wherein two second power supply terminals are connected to two ends of the second line segment, respectively;

wherein the two second power terminals are located at the first side of the display panel, and the two second power terminals are connected to the two ends of the second line segment via a second line, respectively; and wherein an absolute value of a voltage at the second power terminal is greater than an absolute value of a voltage at the first power terminal.

5. The display device according to claim 4, wherein the first power supply terminal and the second power supply terminal both provide a high level or both provide a low level.

* * * * *